US006588438B1

(12) United States Patent
Steiner

(10) Patent No.: US 6,588,438 B1
(45) Date of Patent: Jul. 8, 2003

(54) FREE-ARM SHADE

(76) Inventor: Walter Steiner, Santisstrasse 52, CH-8311 Brutten (CH)

( * ) Notice: Subject to any disclaimer, the term of this patent is extended or adjusted under 35 U.S.C. 154(b) by 0 days.

(21) Appl. No.: 09/707,760

(22) Filed: Nov. 7, 2000

(30) Foreign Application Priority Data

Nov. 7, 1999 (CH) ..... 2035/99

(51) Int. Cl.[7] ..... A45B 11/00
(52) U.S. Cl. ..... 135/20.1; 135/21; 135/23
(58) Field of Search ..... 135/90, 98, 20.3, 135/20.1, 21, 19, 15.1

(56) References Cited

U.S. PATENT DOCUMENTS 504,900 A * 9/1893 Barnes ..... 135/21
4,586,525 A * 5/1986 Glatz ..... 135/20.1
5,116,258 A * 5/1992 Vennik ..... 135/20.3
5,611,364 A * 3/1997 Woods ..... 135/21
5,678,585 A * 10/1997 May ..... 135/20.1
5,937,882 A * 8/1999 Harbaugh ..... 135/20.3
5,960,806 A * 10/1999 Steiner ..... 135/20.1
6,196,242 B1 * 3/2001 Xu ..... 135/20.1
6,220,261 B1 * 4/2001 Glatz ..... 135/20.3
6,305,394 B1 * 10/2001 Reese ..... 135/20.1
6,412,506 B1 * 7/2002 Reese

* cited by examiner

*Primary Examiner*—Lanna Mai
(74) *Attorney, Agent, or Firm*—Edwin D. Schindler

(57) ABSTRACT

The free-arm shade has radial shade ribs (6), support ribs (7) attached to the latter, and a shade rod slide (8) that is freely attached to support ribs (7). It also has a decentral pole (1) standing outside the shade. One of the shade ribs is vertically displaceably attached to pole (1) by its outer end, and functions as a side arm (2). On its top side, it is connected to pole tip (11) via an articulated rib (4), with this shade rib (2) having a pivot joint (13) between the edge of the shade fabric and the pole. Articulated rib (4) is connected to shade rib (2) via a pivot hinge (12). Shade rib (2) can therefore be pivoted around the axis between pivot joint (13) and pivot hinge (12) so that the entire shade can be tilted sideways in relation to pole (1).

5 Claims, 3 Drawing Sheets

FREE-ARM SHADE

BACKGROUND OF THE INVENTION

Figure 1:
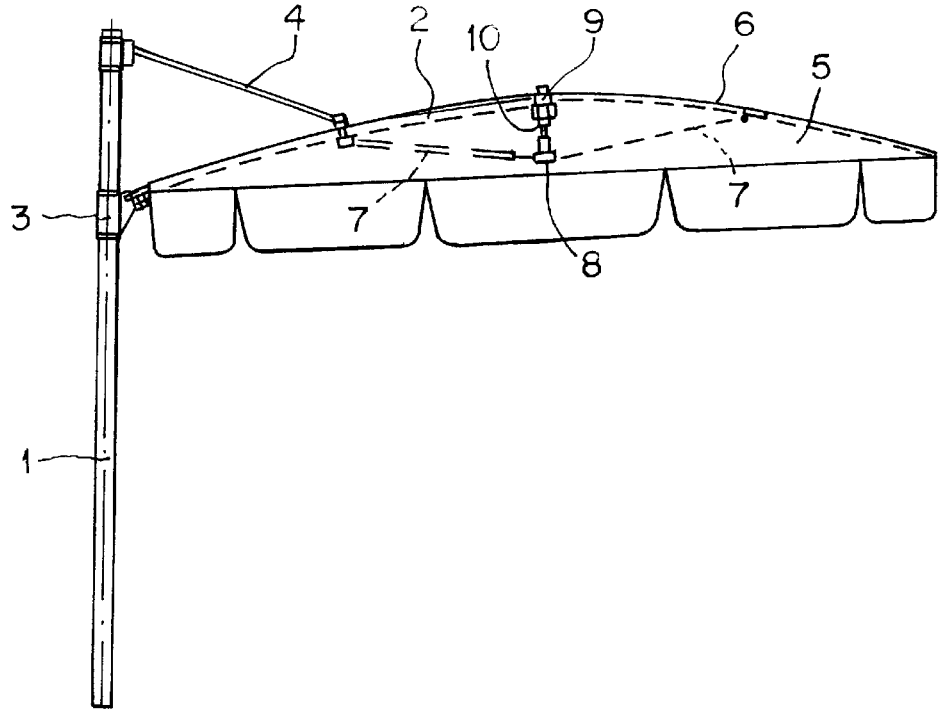

This invention relates to a free-arm shade, in particular one that is primarily, but not exclusively, intended as a sunshade. Prior art free-arm shades have a decentral pole and shade fabric that is stretched taut by radial shade ribs and support ribs attached to the latter. Attached to the bottom ends of the support ribs, there is a freely suspended shade rod slide. The shade is fixed by its shade crown, or by an entire shade rib, to a side arm, which is in turn vertically displaceably attached to the pole standing next to the shade by means of a sliding sleeve, with the side arm being suspended from an articulated rib which is connected to the pole tip. When the sliding sleeve on the side arm is moved downwards, the latter points almost vertically upwards, and lies against the pole. When the sliding sleeve is moved upwards, the side arm is swung outwards, away from the pole, and points obliquely upwards. The shade is then opened by pulling on a cord. This cord runs from the pole via the side arm to the shade crown, and from there down to the shade rod slide that is suspended freely from the bottom ends of the support ribs. By pulling on the cord, the slide is pulled upwards and over a stem moulded underneath the shade crown, with which it engages by means of a catch. The shade fabric is now stretched taut. To shut the shade, the catch stop on the shade slide is released, after which the shade can be folded down. Finally, the side arm is raised by moving the sliding sleeve down the pole.

The disadvantage of free-arm shades of this type, where the whole shade is suspended from the side arm by its shade crown, is that the shade axis of the taut shade always runs vertical, and the shade cannot be tilted against the sun.

Where the shade is attached to the side arm by one of its shade ribs, the angle of the side arm can at least be adjusted to tilt the taut shade in one plane, namely around the pivot axis of the side arm. It is not possible, however, to tilt the taut shade in other directions.

SUMMARY OF THE INVENTION

The task of this invention is to develop the design of such a free-arm shade further so that the taut shade can also be pivoted around the longitudinal axis of the side arm, and, furthermore, so that the whole shade construction is considerably simplified by using less parts than in previous constructions, thereby also reducing manufacturing costs.

This task is solved by a free-arm shade with radial shade ribs, support ribs attached to the latter, and a shade rod slide that is freely attached to the support ribs, as well as a decentral pole standing outside the shade, characterised in that one of the shade ribs is constructed as a side arm which is vertically displaceably attached to the pole by its outer end, and is connected to the tip of the pole on its top side by means of an articulated rib, with this shade rib having a pivot joint between the edge of the shade fabric and the pole, and the articulated rib being connected to the shade rib via a pivot hinge in such a way that this shade rib can be pivoted around the axis between the pivot joint and the pivoting hinge.

The drawings illustrate different views of an embodiment of this free-arm shade, which will be described in detail below with an explanation of how it works, and how it is operated.

BRIEF DESCRIPTION OF THE DRAWINGS FIGURES

Figure 2:
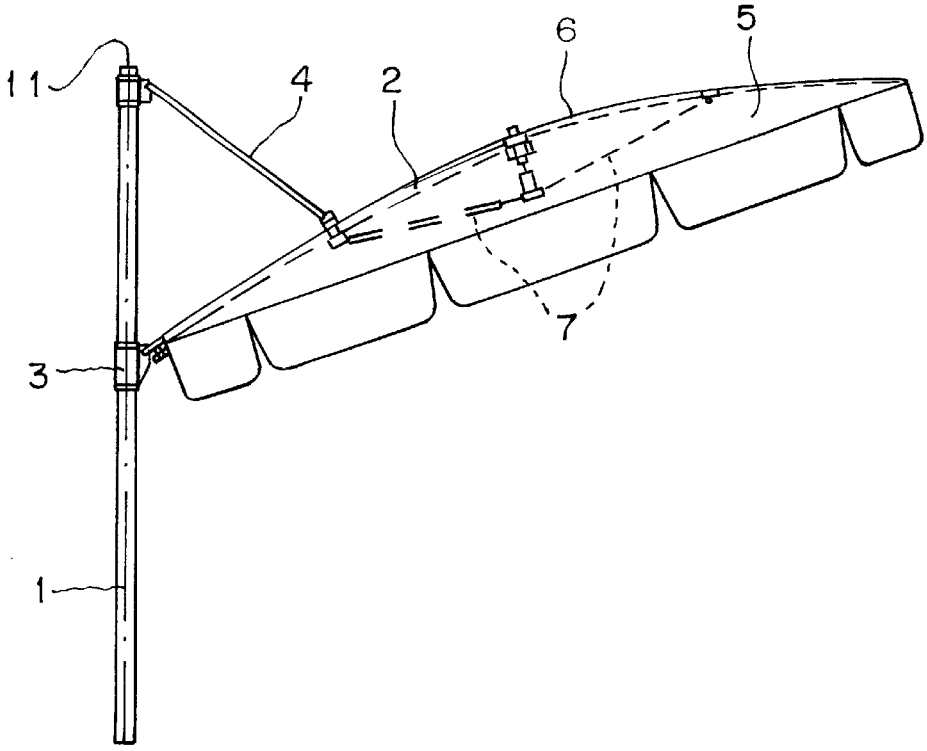
Figure 3:
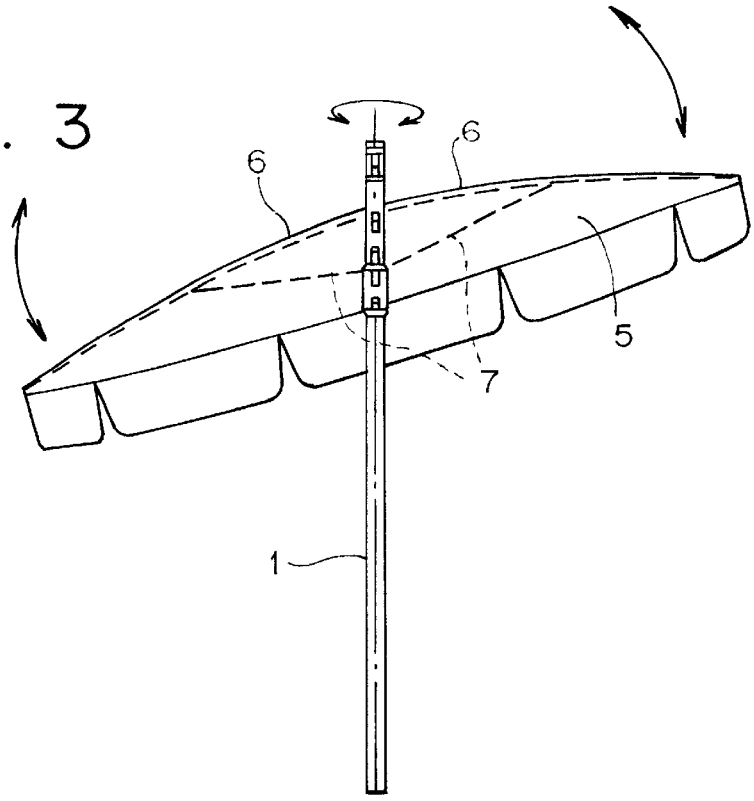
Figure 4:
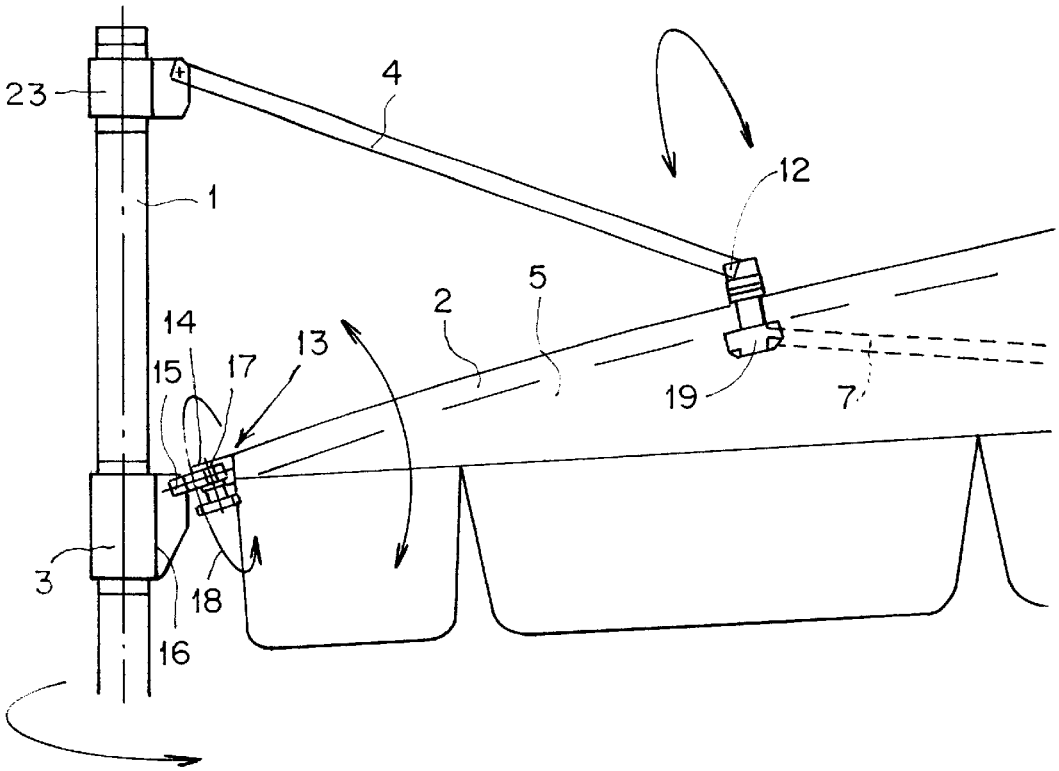
Figure 5:
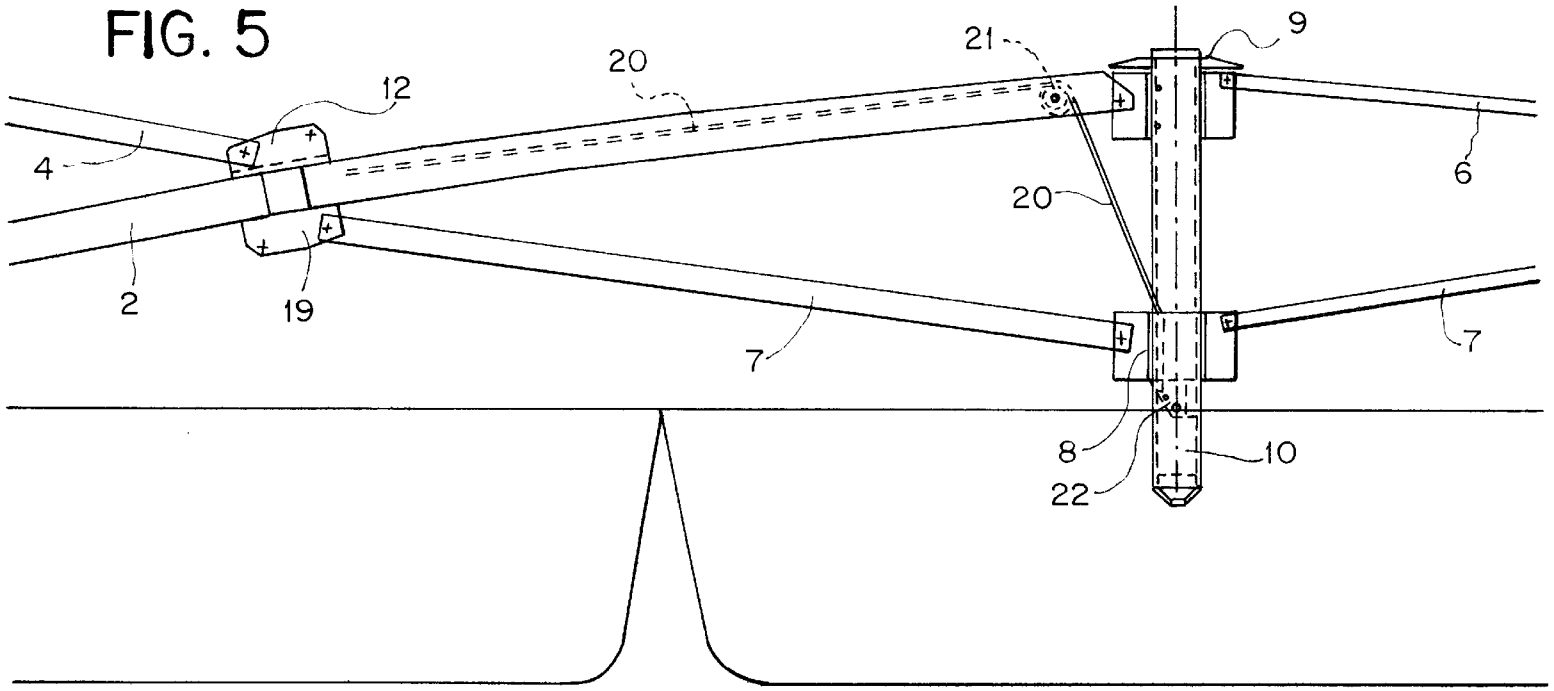
Figure 6:
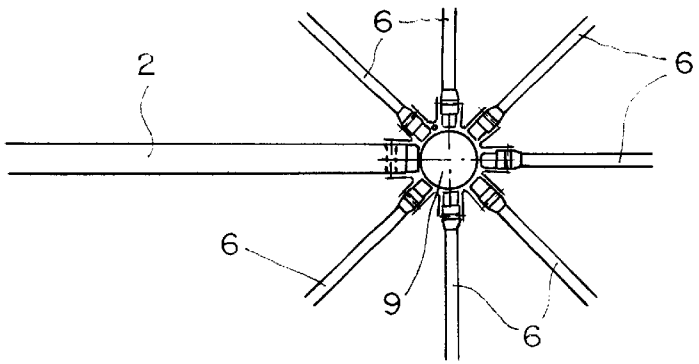

The drawings show:

FIG. 1: The free-arm shade with the shade stretched taut, where the shade is almost horizontal;

FIG. 2: The free-arm shade with the shade stretched taut in a tilted position, somewhat pivoted in the pivot plane of the side arm;

FIG. 3: The free-arm shade with the shade stretched taut in a tilted position, seen from behind, with the shade pivoted around the longitudinal axis of the side arm;

FIG. 4: A detailed view of the pole, the side arm-shade rib and the articulated rib, with the shade fabric stretched taut;

FIG. 5: A detailed view of the shade crown and slide, with the shade ribs and support ribs attached to it;

FIG. 6: A top plan view of the top of the shade crown seen from above with the shade ribs and the side arm.

DETAILED DESCRIPTION OF THE DRAWING AND PREFERRED EMBODIMENTS

The essential elements of this free-arm shade are shown in FIG. 1. It has a decentral pole 1, to which one shade rib 2 of shade ribs 6 is vertically displaceably attached as side arm 2 by means of a sliding sleeve 3. This shade rib 2, resp. this side arm 2, is also attached to pole 1 higher up by means of an articulated rib 4. Shade fabric 5 is stretched taut by a plurality of radial shade ribs 2,6 for which purpose support ribs 7 are provided as usual, to whose ends a shade rod slide 8 is freely attached. The shade has no actual shade rod of its own, however. Instead, all that is disposed on shade crown 9 is a downwardly projecting stem 10, over which slide 8 engages when the shade is stretched taut. The various shade ribs 2,6 are advantageously made from square steel profiles which are slightly curved, with shade rib 2, which functions as side arm 2, being reinforced in that it is made from a steel profile of a larger dimension. Round pipes or profiles with other cross-sections could also be used instead of square profiles.

The entire shade is essentially supported by the shade rib 2 that also functions as side arm 2. FIG. 2 now shows how the shade can adopt a tilted position. For this purpose sliding sleeve 3 is moved down pole 1. To ensure that sliding sleeve 3 can be stopped at different, finely graduated heights along pole 1, it has a spring-loaded stop pin which engages in corresponding holes along pole 1. To move sliding sleeve 3, this stop pin can be disengaged, whereupon sliding sleeve 3 can be moved along pole 1. So, starting from the position shown in FIG. 1, sliding sleeve 3 was moved downwards, which causes the shade to tilt as shown. In this example, articulated rib 4 is attached in a fixed position to pole tip 11, but can also be displaceably attached to pole 1 as described later. As the sun reaches its highest point in the day, the shade is used in a virtually horizontal position as shown in FIG. 1. Once the sun starts to drop towards the horizon, the shadow generated by the shade can be enlarged by tilting the shade as shown in FIG. 2.

FIG. 3 shows the free-arm shade with the shade stretched taut in a differently inclined position seen from the back, namely with the shade being pivoted around the longitudinal axis of side arm 2. This pivoting capacity is new, and makes it possible to adjust the shade much better to different localities and sun positions. If, for example, a table is positioned in a garden so that the pole cannot be set up on the side of the table nearest the sun, a shade that can only be tilted in the pivot plane of the side arm will not generate a shadow that really covers the table. So, if the table is positioned under the shade in FIG. 2, and the sun shines in precisely from the left and is already low on the horizon because it is late in the day, the shade in this Figure would have to be moved further to the left. If that is impossible because of the layout of the locality, the shade is of no use.

It is only of any use if it can also be tilted in the way shown in FIG. 3. In the circumstances just described it then becomes possible, seen from the direction of the sun, to position shade pole 1 at the side of the table, i.e. in FIG. 2, in which the sun shines in from the left, seen in the direction onto the page of drawings, behind or in front of the table positioned underneath the shade roof in that Figure. If the sun shines in from the left in FIG. 3, too, the table is positioned behind pole 1 and pole 1, seen from the direction of the sun, stands to the right of the table. Thanks to the new construction enabling the shade to be tilted laterally as shown in FIG. 3, the shadow generated can be adjusted so that even when the sun is very low and space is restricted, the people sitting at the table are actually seated within the shade afforded by the parasol. In FIG. 3 the shade is tilted slightly to the left. It is also possible to tilt the shade in the opposite direction, i.e. to the right, in exactly the same way. This pivot zone in the sideways direction can easily amount to approx. 100° or more. Seen from along side arm 2, the centre of gravity of the shade itself is always located close to the effective pivot axis so that virtually no large moments of force occur in the sideways direction, thereby guaranteeing the stability of the free-arm shade. The shade can also be fixed in any sideways position by means of a clamping screw.

FIG. 4 shows a detailed view of pole 1, side arm-shade rib 2 and articulated rib 4, with the shade fabric 5 stretched taut. Mounted on top of side arm-shade rib 2 there is a pivot hinge 12, to which articulated rib 4 is hingeingly attached. At the point where side arm-shade rib 2 is attached to sliding sleeve 3, there is a pivot joint 13. For this purpose, the end of side arm-shade rib 2 is provided with a collar 14, into which fits a round bar or a bolt 15, which, in this embodiment, is pivotably attached in the plane of the Figure to two ears 16 projecting from sliding sleeve 3. Pivot joint 13 has a clamping screw 17 with a grip wheel 18. This clamping screw 17 can be tightened in whatever tilted position is required so that it fixes this position. Wheel 18 with its approximately palm-sized diameter allows the operator to apply sufficient torque to tighten clamping screw 17 without any tools. When side arm-shade rib 2 is rotated, i.e. the shade is pivoted sideways, side arm-shade rib 2 rotates around the axis of rotation of pivot joint 13 formed by bolt 15 and collar 14 on the one hand, whilst also pivoting around the hinge axis of pivot hinge 12 on the other hand. Shade fabric 5 rests on side arm-shade rib 2 in exactly the same way as it does on all the other shade ribs 6. It is stretched taut by the shade ribs 2,6, which are pushed apart by support ribs 7. These support ribs 7 are attached to the underneath of shade ribs 2,6 to the connecting elements 19 provided there.

FIG. 5 shows a detailed view of shade crown 9 and shade rod slide 8 with the shade ribs 2,6 attached to shade crown 9, as well as support ribs 7, on which the former rest. Also drawn in is the cord 20, which, in this embodiment, is elegantly run through the inside-of side arm-shade rib 2, deflected via roller 21 and then run through a recess in the profile of side arm-shade rib 2 down to slide 8. When the shade is stretched taut, as shown here, slide 8 is run over stem 10 which is disposed underneath shade crown 9. Slide 8 engages with stem 10 by means of a special spring-loaded catch 22. When the shade has to be folded down, the operation is started by releasing the catch 22 provided on slide 8, whereupon slide 8 slides slightly down along stem 10. Cord 20 is then released, and slide 8 moves further down, slips off stem 10 and the shade folds down completely, after which slide 8 is left freely suspended, connected only to the bottom ends of support ribs 7.

To finish with, FIG. 6 shows shade crown 9 with shade ribs 6 and the shade rib 2, which also functions as side arm 2, seen from above in a top plan view. As can be seen here, side arm-shade rib 2 is designed to be stronger, because it also has to carry the whole shade, as well as having to start off and maintain the sideways tilt. From the outside, however, the shade looks extremely simple and uncluttered, namely because side arm 2 is completely invisible—all that can be seen are the pole 1 and cross rib 4, as well as shade fabric 5, of course, as is shown in FIGS. 1 and 2. The fact that one of the shade ribs is simultaneously constructed as the side arm means that there is no need for a specially made side arm, whilst the shade also looks more elegant from the outside, because there is no awkward connecting rod running around one of the outsides.

A further means of adjusting the shade can be realised by designing it so that not only sliding sleeve 3 can be vertically displaced along pole 1, but also the sleeve 23 that is disposed on the pole tip 11, and to which is attached articulated rib 4, as shown in FIG. 4. If this sleeve 23 is also designed to be vertically displaceable in an identical or similar manner as sliding sleeve 3, the entire shade can be vertically adjusted along pole 1. This is particularly convenient when the sun sets very low. All in all, this free-arm shade is made with an ultra-simple, user-friendly construction whilst also offering hitherto unknown versatility as regards the way it can be adjusted vertically, sideways and longitudinally.

What is claimed is:

1. A free-arm shade, comprising:

a decentral pole having a tip;

an articulated rib;

a sliding sleeve; and, radial shade ribs with one of said radial shade ribs being a side arm, said side arm being vertically displaceably attached to said decentral pole by an outer end of said side arm and connected to said tip of said decentral pole on its top side via said articulated rib, with said side arm being attached to a pivot hinge and sitting in a pivot joint, which is articulated to said sliding sleeve and vertically movable along said decentral pole, said articulated rib being connected to said side arm via a pivot hinge, so that said side arm is pivotable around a longitudinal axis of said side arm between said pivot joint and said pivot hinge.

2. The free-arm shade according to claim 1, wherein said pivot joint is capable of being fixed in varying rotated positions via a clamping screw.

3. The free-arm shade according to claim 2, wherein said pivot joint comprises a collar and a bolt, with said bolt fitting inside said collar, with a wall of said collar being pierced by said clamping screw with a grip handle.

4. The free-arm shade according to claim 1, wherein said pivot joint comprises a collar and a bolt, with said bolt fitting inside said collar, with a wall of said collar being pierced by a clamping screw with a grip handle.

5. The free-arm shade according to claim 1, wherein all of said radial shade ribs are curved square profiles, with said one of said radial shade ribs being of a stronger construction than other said radial shade ribs.

* * * * *